US007915550B2

(12) United States Patent
Beaulieu

(10) Patent No.: US 7,915,550 B2
(45) Date of Patent: Mar. 29, 2011

(54) PNEUMATIC SYSTEM ELECTRICAL CONTACT DEVICE

(75) Inventor: Gilles Beaulieu, Trois-Rivieres (CA)

(73) Assignee: MAC Valves, Inc., Wixom, MI (US)

( * ) Notice: Subject to any disclaimer, the term of this patent is extended or adjusted under 35 U.S.C. 154(b) by 416 days.

(21) Appl. No.: 12/140,554

(22) Filed: Jun. 17, 2008

(65) Prior Publication Data

US 2009/0308721 A1 Dec. 17, 2009

(51) Int. Cl.
*H01H 1/06* (2006.01)
*H01H 35/38* (2006.01)

(52) U.S. Cl. ..... 200/275; 200/82 R; 200/276

(58) Field of Classification Search ..... 200/51 R, 200/51.09, 51.12, 81 R, 81.9 R, 82 R, 82 C, 200/82 A, 275, 276, 81.5, 82 B, 84 R; 439/246, 439/252, 66, 68, 824, 843, 700
See application file for complete search history.

(56) References Cited

U.S. PATENT DOCUMENTS

| | | | | |
|---|---|---|---|---|
| 3,006,825 | A | 10/1961 | Ovrom Sem | |
| 3,371,026 | A | 2/1968 | Kiley et al. | |
| 3,663,411 | A | 5/1972 | Springer | |
| 3,679,555 | A * | 7/1972 | Duclaux et al. | 205/392 |
| 3,681,229 | A | 8/1972 | Lowe | |
| 3,942,366 | A * | 3/1976 | Hofmann | 73/114.47 |
| 4,016,053 | A | 4/1977 | Stankovich et al. | |
| 4,019,561 | A | 4/1977 | Aoki | |
| 4,028,511 | A * | 6/1977 | Wack et al. | 200/82 R |
| 4,035,251 | A | 7/1977 | Shiver et al. | |
| 4,049,529 | A | 9/1977 | Golla | |
| 4,053,384 | A | 10/1977 | Siegmund | |
| 4,070,008 | A | 1/1978 | Schlieckmann | |
| 4,085,305 | A * | 4/1978 | Dietz | 200/83 A |
| 4,092,118 | A | 5/1978 | Muhle | |
| 4,228,924 | A | 10/1980 | Gilbert | |
| 4,321,115 | A | 3/1982 | Rebmann et al. | |
| 4,328,085 | A | 5/1982 | Friedli et al. | |
| 4,332,660 | A | 6/1982 | Friedli et al. | |
| 4,349,231 | A | 9/1982 | Gut et al. | |
| 4,377,452 | A | 3/1983 | Casdas | |
| 4,431,491 | A | 2/1984 | Bonny et al. | |
| 4,437,964 | A | 3/1984 | Gerphagnon et al. | |
| 4,469,281 | A | 9/1984 | Røed | |
| 4,480,160 | A * | 10/1984 | Stifelman | 200/82 R |
| 4,510,033 | A | 4/1985 | Martin et al. | |

(Continued)

FOREIGN PATENT DOCUMENTS

| | | |
|---|---|---|
| CA | 800598 | 12/1968 |

(Continued)

*Primary Examiner* — Michael A Friedhofer
(74) *Attorney, Agent, or Firm* — Harness, Dickey & Pierce, P.L.C.

(57) ABSTRACT

An electrical circuit operating system for controlling operating of an aluminum processing bath includes an electrical contact device. The electrical contact device includes a tubular body of an electrically insulating material, the body including at least one circumferential slot receiving a seal member. A fastener is disposed in the tubular body. A conductive biasing element has a compressed connecting end engaged with the fastener, and an extending portion axially protracting from the compressed connecting end. A piston forms a portion of an electrical circuit. The electrical circuit is closed when the conductive biasing element is contacted by the piston. A piston rod is connected to the piston and is displaceable with the piston, the piston rod operable to break a crust of the aluminum processing bath.

36 Claims, 10 Drawing Sheets

U.S. PATENT DOCUMENTS

| | | | | |
|---|---|---|---|---|
| 4,534,401 | A | 8/1985 | Schaumburg et al. | |
| 4,563,255 | A | 1/1986 | Heinzmann et al. | |
| 4,617,100 | A | 10/1986 | Boughton | |
| 4,755,637 | A * | 7/1988 | Turck | 200/82 R |
| 5,011,399 | A | 4/1991 | Farrell | |
| 5,045,168 | A | 9/1991 | Dalen et al. | |
| 5,078,849 | A | 1/1992 | Sagbraten | |
| 5,225,641 | A * | 7/1993 | Weld et al. | 200/81.9 R |
| 5,294,318 | A | 3/1994 | Grant, Jr. et al. | |
| 5,477,675 | A | 12/1995 | Ingraham et al. | |
| 5,540,556 | A | 7/1996 | Du | |
| 5,613,834 | A | 3/1997 | Du | |
| 5,749,709 | A | 5/1998 | Du | |
| 5,779,875 | A | 7/1998 | Budaev et al. | |
| 6,436,270 | B1 | 8/2002 | Sander | |
| 6,440,294 | B1 | 8/2002 | Cotten | |
| 6,555,050 | B1 * | 4/2003 | Groteke et al. | 266/78 |
| 6,649,035 | B2 | 11/2003 | Horstmann et al. | |
| 6,755,112 | B2 | 6/2004 | Burgdorf et al. | |
| 7,114,597 | B2 | 10/2006 | Siebke | |
| 2008/0066834 | A1 * | 3/2008 | Jepson | 148/633 |

FOREIGN PATENT DOCUMENTS

| | | |
|---|---|---|
| CA | 1022497 | 12/1977 |
| GB | 1 262 069 | 2/1972 |

* cited by examiner

PNEUMATIC SYSTEM ELECTRICAL CONTACT DEVICE

FIELD

The present disclosure relates to contact devices used to close electrical circuits.

BACKGROUND

The statements in this section merely provide background information related to the present disclosure and may not constitute prior art.

Known systems used to control operations of aluminum processing baths can include electrical circuits closed when a crust breaking tool breaks an aperture through the hardened upper crust formed on the bath and either encounters a layer of alumina, or the molten layer of aluminum below the layer of alumina. The aperture formed through the crust is necessary to permit feeding new alumina material into the bath. When the electrical circuit closes, a signal is created which directs the crust breaking tool to retract from the crust layer. An example of such a system is disclosed in U.S. Pat. No. 6,649,035 to Horstmann et al. A drawback of such systems occurs when crust material forms on the crust breaking tool or corrosive effects of the bath prevent completion of the electrical circuit.

In this situation, the crust breaking tool can remain in the bath for an undesirable length of time which can further damage the crust breaking tool, or render the detection system inoperative, which prevents feeding of the alumina material, or identification of how many feed events have occurred. A further drawback is the crust breaking tool is generally driven by a system using high pressure air. The longer the crust breaking tool is suspended, the greater volume of high pressure air is required, which increases operating costs of the system and may increase the number of air compressors and air dryers required for operation.

SUMMARY

According to several embodiments of the present disclosure, an electrical contact device operable to complete an electrical circuit includes a tubular body of an electrically insulating material. The body includes a seal member to permit the tubular body to be sealingly disposed within a cylinder. A fastener is received in the tubular body. The fastener includes a shank and a plurality of threads. A conductive biasing element has a compressed connecting end engaged with the plurality of threads, and an extending portion extending from the compressed connecting end.

According to other embodiments, an electrical contact device operable to complete an electrical circuit includes a tubular body of an electrically insulating material. The tubular body includes an open receiving end having a fastener clearance bore, an internally threaded bore, and a biasing element clearance bore. A fastener made of an electrically conductive material includes a shank having a plurality of external shank threads adapted to be threadably engaged with the internally threaded bore, and a shank extension extending axially from the shank. A conductive biasing element includes a compressed connecting end mechanically and conductively engaged with the shank extension, and a extending portionextending from the compressed connecting end.

According to other embodiments, an electrical circuit operating system includes an electrical contact device having a tubular body of an electrically insulating material. The body includes a seal member. A fastener is disposed in the tubular body. A conductive biasing element has a compressed connecting end engaged with the fastener, and an extending portion axially protracting from the compressed connecting end. A displaceable member forms a portion of an electrical circuit, the electrical circuit closed when the conductive biasing element is contacted by the displaceable member.

According to still other embodiments, an operating system is operable to direct a pressurized fluid to displace the displaceable member.

According to still other embodiments, an electrical circuit operating system for controlling operating of an aluminum processing bath includes an electrical contact device. The electrical contact device includes a tubular body of an electrically insulating material, the body including a seal member. A fastener is disposed in the tubular body. A conductive biasing element has a compressed connecting end engaged with the fastener, and an extending portion axially protracting from the compressed connecting end. A piston forms a portion of an electrical circuit. The electrical circuit is closed when the conductive biasing element is contacted by the piston. A piston rod is connected to the piston and is displaceable with the piston, the piston rod operable to break a crust of the aluminum processing bath.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
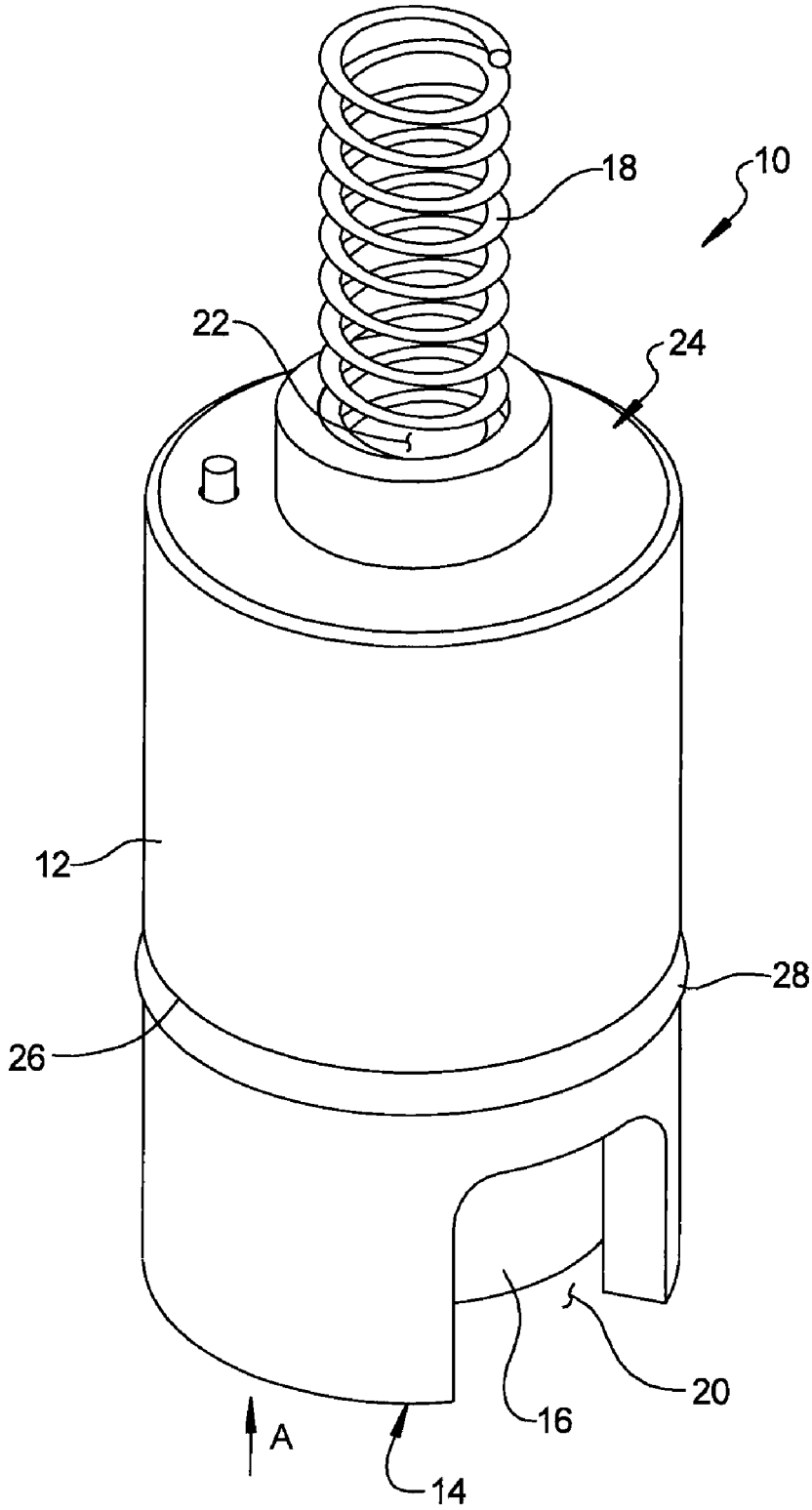
FIG. 1 is a front perspective view of a pneumatic system electrical contact device of the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1, an electrical connector assembly 10 includes an electrically insulating tubular body 12 having an open receiving end 14 through which is received a fastener 16. A biasing element 18 such as a coiled compression spring is electrically and mechanically connected to the fastener 16 and extends outwardly of tubular body 12. An access cavity 20 is provided in a wall of tubular body 12 to provide access to fastener 16 to extend an electrical connection with fastener 16. The biasing element 18 extends partially through and outwardly from a biasing element bore 22 which is created through an end face 24 of tubular body 12. End face 24 is oppositely positioned from the open receiving end 14.

According to several embodiments, a seal is provided with tubular body 12 so tubular body 12 can form a portion of a pressure boundary. The seal can be formed as a flange extending from the tubular body, an O-ring seated about the tubular body 12, a raised surface of the tubular body 12, and the like. According to several embodiments and as shown in FIG. 1, at least one perimeter or circumferential slot 26 is provided in tubular body 12 which is adapted to receive a seal member 28 such as an elastomeric O-ring. As noted above, circumferential slot 26 can be eliminated and seal member 28 can be formed as a protuberance, flange, or extension of tubular body 12.

Fastener 16 is assembled into tubular body 12 in an insertion direction "A" through open receiving end 14. According to several embodiments, fastener 16 is pre-connected to biasing element 18 such that both fastener 16 and biasing element 18 can be together loaded into tubular body 12 at the same time in the insertion direction "A". Fastener 16 is adapted to be threadably received within tubular body 12. A material of tubular body 12 is selected from an electrically non-conductive material, which according to several embodiments can be a polymeric material such as a polytetrafluoroethylene, a perfluoroalkoxy material, or a fluorinated ethyleneproplylene material. The material for tubular body 12 is selected both for its temperature resistance and for its ability to provide electrical insulation properties and is not limited to the materials listed above. According to several embodiments, fastener 16 is made from an electrically conductive material including a metal such as steel. Material for the biasing element 18 is also an electrically conductive material which can include a metal such as stainless steel including 1700 stainless steel. According to several embodiments, biasing element 18 is in the form of a coiled compression spring, however biasing element 18 can be provided in other forms that allow for axial or longitudinal deflection.

Figure 2:
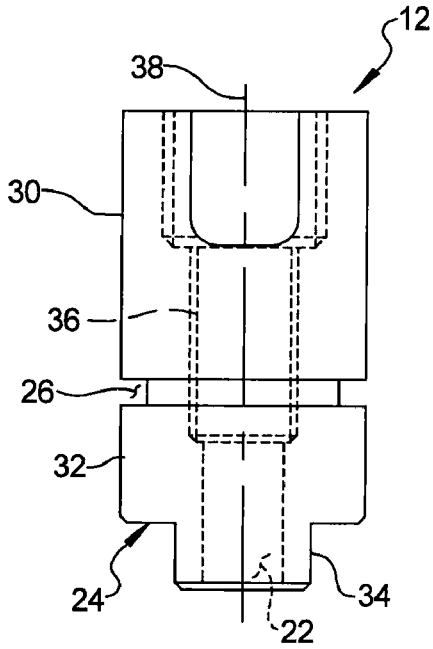
FIG. 2 is a front elevational view of a tubular body for the electrical contact device of FIG. 1.

Referring to FIG. 2, according to embodiments that provide for seal member 28 as an elastomeric O-ring, tubular body 12 includes a first body portion 30 and a second body portion 32 separated from first body portion 30 by perimeter slot 26. A raised boss 34 extends longitudinally from and is homogenously joined to second body portion 32. Boss 34 has a diameter smaller than a diameter of either first or second body portions 30, 32. Boss 34 is provided to extend an axial length of biasing element bore 22 to assist with maintaining an axial alignment of biasing element 18 as biasing element 18 extends freely away from tubular body 12. An internal threaded bore 36 is also provided in tubular boy 12 which is coaxially aligned together with biasing element bore 22 on a bore longitudinal axis 38 of tubular body 12. Boss 34 extends axially away from end face 24 and can be coaxially aligned with bore longitudinal axis 38.

Figure 3:
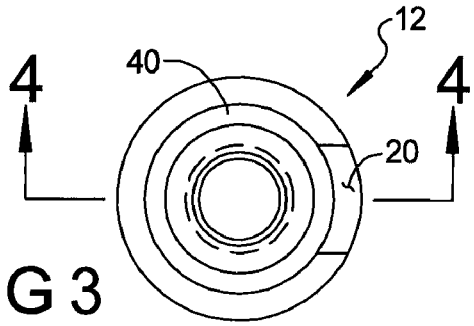
FIG. 3 is a top plan view of the electrical contact device of FIG. 1.

Referring to FIG. 3, a fastener clearance bore 40 can be created in tubular body 12. Fastener clearance bore 40 is sized to slidably receive fastener 16. Access cavity 20 extends transversely with respect to fastener clearance bore 40.

Figure 4:
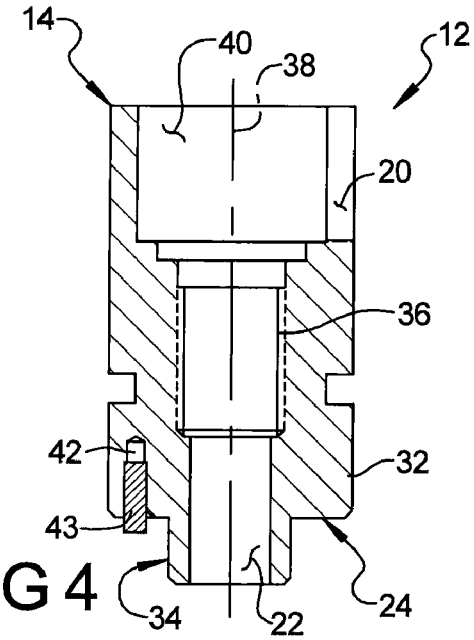
FIG. 4 is a cross sectional front elevational view taken at section 4 of FIG. 3.
Figure 5:
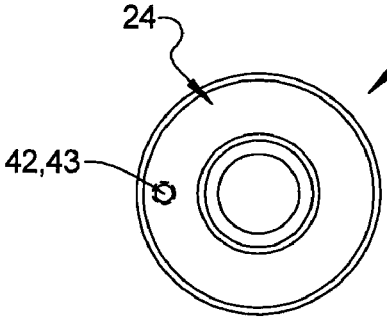
FIG. 5 is a bottom plan view of the electrical contact device of FIG. 1.

Referring to FIGS. 4 and 5, a perimeter aperture 42 is created in end face 24 and extends substantially parallel to bore longitudinal axis 38. According to several embodiments, perimeter aperture 42 is a blind aperture opening only from end face 24 and extending partially through second body portion 32. Perimeter aperture 42 is adapted to engagingly receive an anti-rotation pin 43 whose function will be described in reference to FIG. 12. According to several embodiments, fastener clearance bore 40 has a larger diameter than a diameter of internal threaded bore 36, which in turn has a larger diameter than a diameter of biasing element bore 22.

Figure 6:
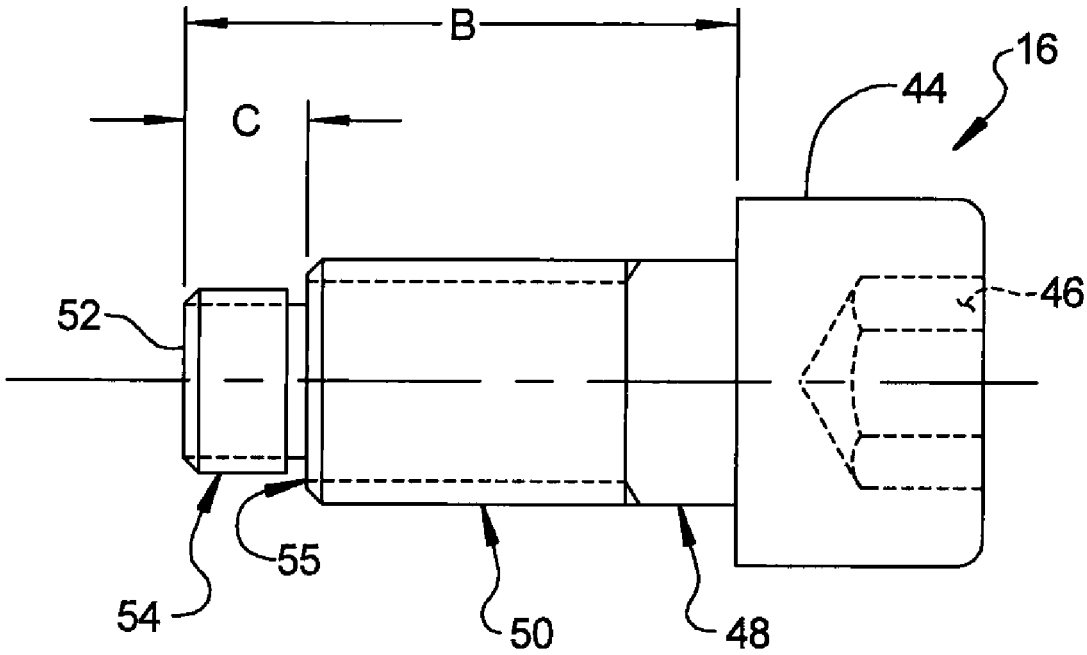
FIG. 6 is a side elevational view of a fastener for the electrical contact device of FIG. 1.

Referring to FIG. 6, fastener 16 includes a fastener head 44 which has a recessed drive slot 46. The geometry of recessed drive slot 46 can be selected to receive one of a plurality of different installation tools for installation of fastener 16. According to several embodiments, recessed drive slot 46 defines a hexagonal slot adapted to receive an Allen wrench. A shank 48 extends axially from fastener head 44. A plurality of male shank threads 50 are created on shank 48. A reduced diameter shank extension 52 having a diameter smaller than a diameter of shank 48 extends axially away from shank 48 and is positioned opposite to fastener head 44. A plurality of male extension threads 54 are created on reduced diameter shank extension 52. According to several embodiments, male extension threads 54 are a 40 UNF left hand thread and male shank threads 50 are a 13 UNC right hand thread. The use of left hand or right hand threads as noted can also be modified within the scope of the present disclosure. An end face 55 is created at a junction between shank 48 and reduced diameter shank extension 52. Fastener 16 can have a total shank length "B" which in several embodiments is 1.125 in (2.86 cm), and reduced diameter shank extension 52 can have an extension length "C" which can be 0.25 in (0.63 cm).

Figure 7:
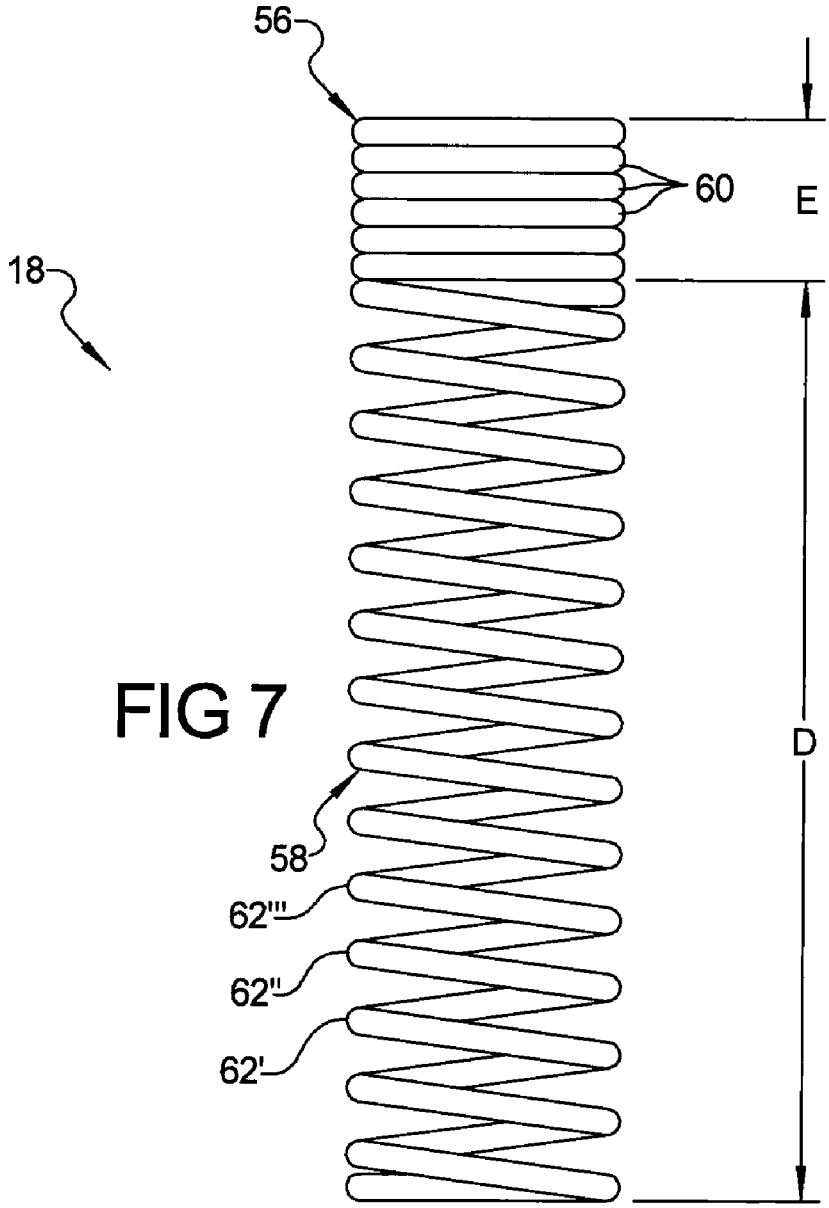
FIG. 7 is a side elevational view of a biasing element for the electrical contact device of FIG. 1.
Figure 8:
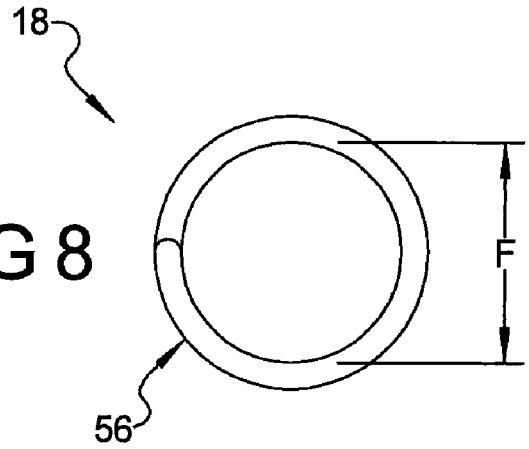
FIG. 8 is a front elevational view of the biasing element of FIG. 7.

Referring to both FIGS. 7 and 8 and again to FIG. 6, biasing element 18 is shown as a coiled spring having a compressed connecting end 56 and a extending portion 58. Compressed connecting end 56 is created by abutting a plurality of coil members 60 such that the coil members 60 define an internal coil path comparable to the geometry of male extension threads 54 of fastener 16 shown and described in reference to FIG. 6. Extending portion58 includes a plurality of spaced coil members 62 spaced for example as shown between exemplary coil members 62', 62", 62''' which allows for axial deflection of the coil members 62. Extending portion 58 can have an extending portion length "D", and compressed connecting end 56 can have a compressed connecting end length "E" which is approximately equal to extension length "C" of reduced diameter shank extension 52. A connecting end internal diameter "F" is provided by the coils of abutting coil members 60, which approximates a root diameter of the male extension threads 54 of fastener 16.

Figure 9:
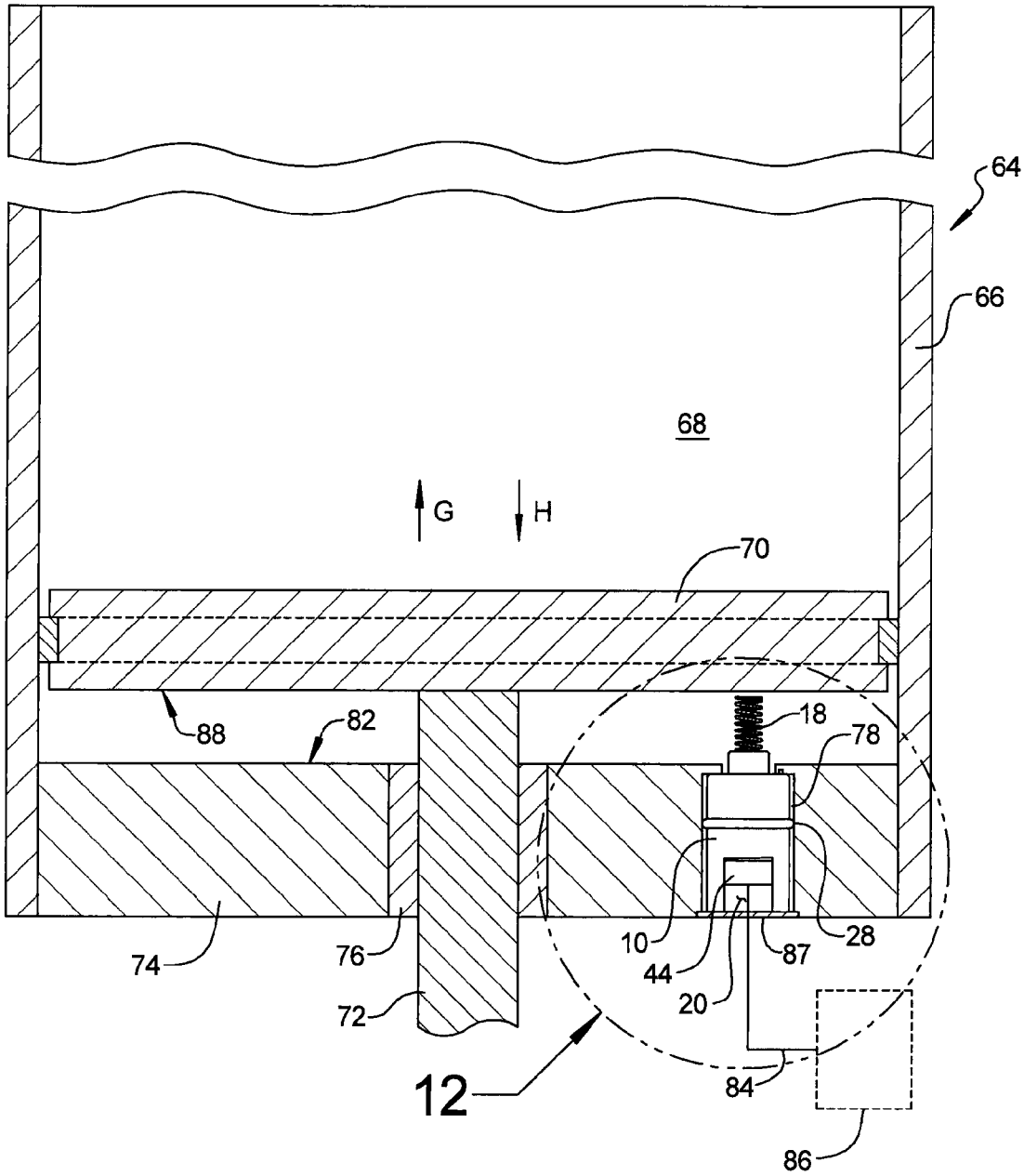
FIG. 9 is a partial cross sectional front elevational view of a piston assembly having the electrical contact device of FIG. 1 installed therein.

Referring to FIG. 9, one exemplary application of electrical connector assembly 10 can be in conjunction with a piston assembly 64. Piston assembly 64 includes a cylinder 66 defining a piston chamber 68 having a piston 70 slidably disposed within piston chamber 68 such that piston 70 can slide in either of a piston return path "G" or a piston drive path "H". One or more seals can be disposed about an outer perimeter of piston 70 as known in the art to provide a pressure containment seal between piston 70 and an inner wall defined by cylinder 66. A piston rod 72 is connected to piston 70 and extends transversely away from piston 70. As piston 70 moves in either of the piston return path "G" or the piston drive path "H", piston rod 72 is slidably moved through a cylinder end wall 74 having an electrically conductive material bearing/seal 76 creating a pressure containing boundary for piston rod 72 and piston chamber 68.

Electrical connector assembly 10 can be slidably received within a connector receiving bore 78 created in cylinder end wall 74. With electrical connector assembly 10 positioned as shown having biasing element 18 extending into piston chamber 68 and toward piston 70, the at least one connector seal member 28 such as a rubber or an elastomeric material O-ring provides a pressure containment seal between electrical connector assembly 10, connector receiving bore 78, and piston chamber 68. A portion of biasing element 18 extends freely from electrical connector assembly 10 and is the only portion of electrical connector assembly 10 positioned within piston chamber 68, having a portion of biasing element 18 freely extending away from an end wall interior face 82 of cylinder end wall 74.

Figure 10:
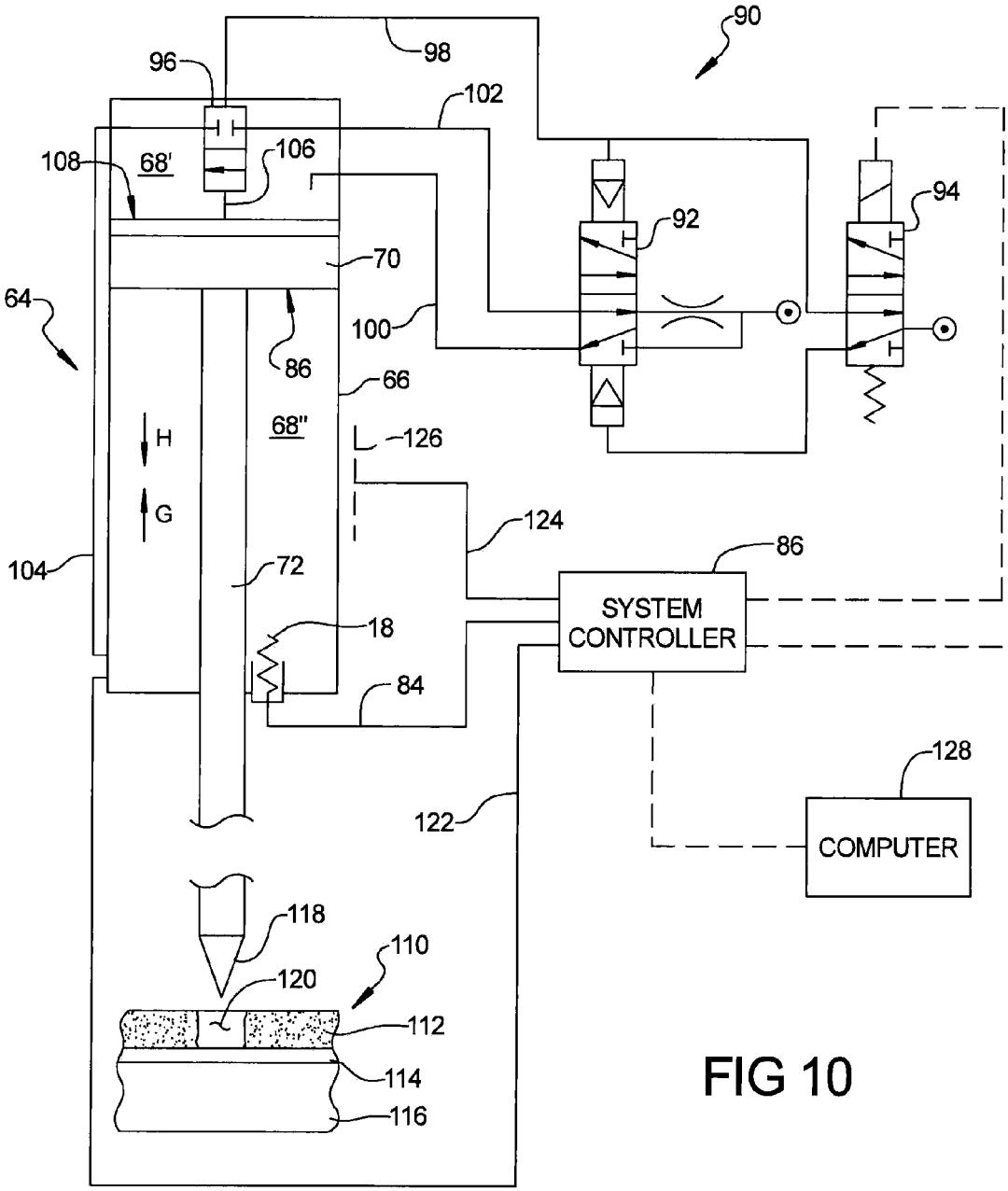
FIG. 10 is a diagrammatic representation of a control system incorporating the electrical contact device of FIG. 1.
Figure 11:
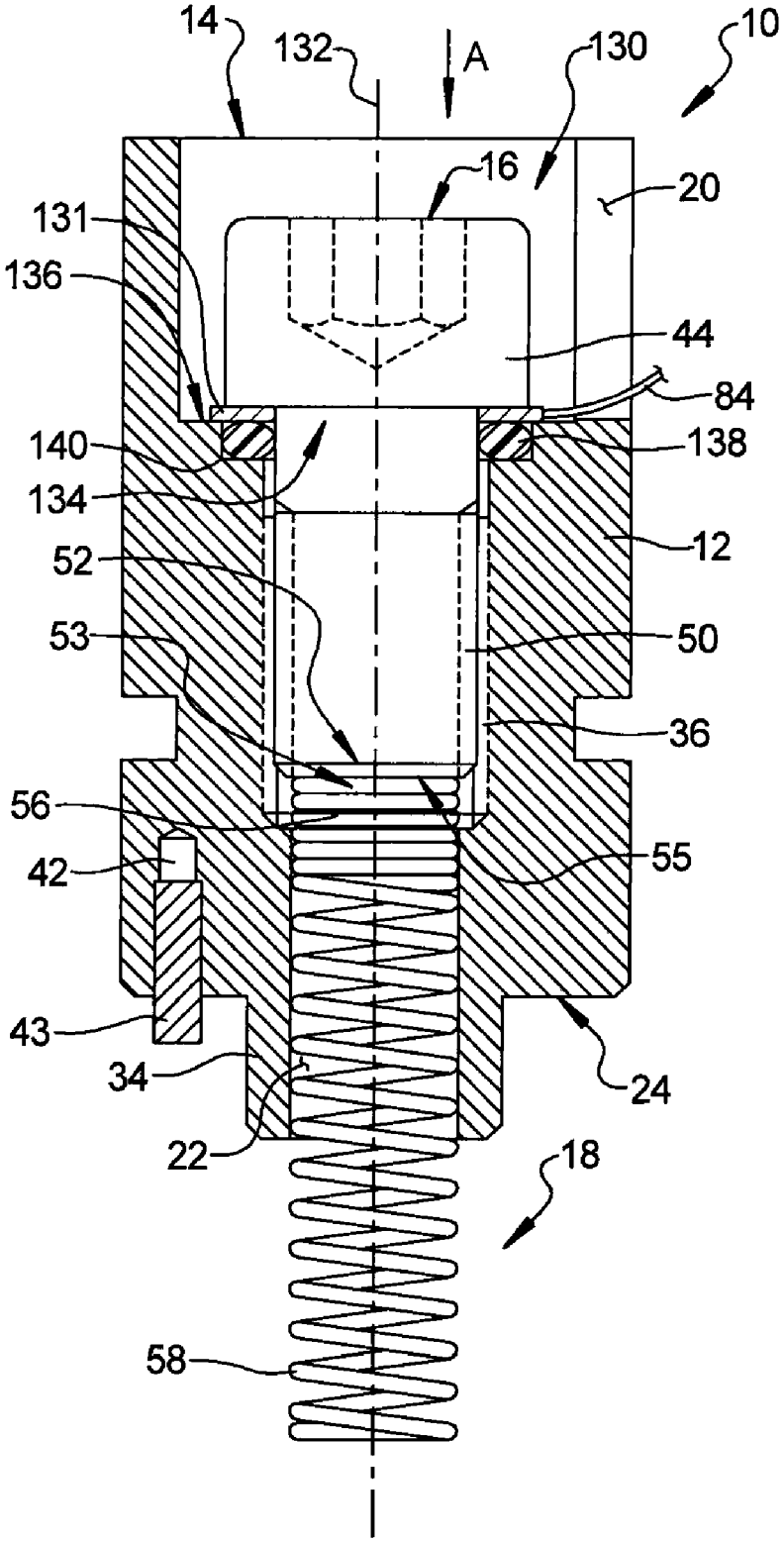
FIG. 11 is a partial cross sectional front elevational view of the electrical contact device of FIG. 1.

An electrical conductor 84 is connected for example by soldering or mechanically connected for example by crimping directly to fastener 16 or by use of a connector that is shown and described in reference to FIG. 11 such that electrical conductor 84 extends through access cavity 20 of electrical connector assembly 10. An opposite end of electrical conductor 84 is connected to a system controller 86 which will be described in reference to FIG. 10. Electrical connector assembly 10 can be retained within connector receiving bore 78 against the pressure within piston chamber 68 using a mechanical connector such as a deflectable clamp ring 87 which engages against the inner wall defined by connector receiving bore 78 to mechanically retain electrical connector assembly 10 within connector receiving bore 78. With the electrical connector assembly 10 and biasing element 18 positioned as shown, biasing element 18 is electrically isolated from cylinder end wall 74 by the material of tubular body 12, and an electrical circuit is completed when a first piston surface 88 contacts biasing element 18. The electrical circuit is partially formed through a path including piston rod 72, piston 70, biasing element 18, fastener 16, and electrical conductor 84 which is connected to system controller 86. Completion of the electrical circuit is therefore not dependent upon a mechanical switch or displacement of a contact member, but only requires physical contact between first piston surface 88 and biasing element 18. To permit piston 70 and piston rod 72 to be part of the electrical circuit, these components are made from an electrically conductive material.

Referring now to FIG. 10, an operating system 90 using electrical connector assembly 10 and piston assembly 64 can be used in conjunction with a supply of a pressurized fluid such as air to direct the displacement of piston 70 and piston rod 72, with piston 70 able to move into contact with biasing element 18. Operating system 90 can include a first control valve 92 and a second control valve 94 which are connected to a source of pressurized air and which direct the pressurized air into the piston chamber 68 to displace piston 70. A mechanically actuated valve 96 can also be provided which is actuated when piston 70 is in a first portion 68' of piston chamber 68.

A control pressure line 98 connected between each of first and second control valves 92, 94 and mechanically actuated valve 96 provides control pressure to each of these valves. A piston drive supply line 100 is connected to first control valve 92 and discharges into the first portion 68' of piston chamber 68 above piston 70 as shown in reference to FIG. 10. Discharge of air via piston drive supply line 100 into piston chamber 68 therefore directs piston 70 in the piston drive path "H". A piston return supply line 102 is connected between first control valve 92 and mechanically actuated valve 96. A piston return connecting line 104 is then connected between mechanically actuated valve 96 and a second portion 68" of piston chamber 68 to direct the source of air to the second portion 68" of piston chamber 68 which is operable to move piston 70 in the piston return path "G". Second control valve 94 receives operating commands from system controller 86 for directing pressurized air into either first or second portion 68', 68" of piston chamber 68.

With piston 70 shown in the furthest upward extended position, an actuator 106 of mechanically actuated valve 96 is contacted by a second piston surface 108. This physical contact with actuator 106 stops the flow of pressurized air within piston return connecting line 104 into second portion 68" of piston chamber 68, therefore stopping the upward motion and establishing an upper travel limit of piston 70. Conversely, when piston 70 is oppositely positioned from that shown and first piston surface 88 contacts biasing element 18 of electrical connector assembly 10, an electrical circuit is completed through electrical conductor 84 to system controller 86 which directs second control valve 94 and therefore first control valve 92 to stop flow of the pressurized air through piston drive supply line 100 into the first portion 68' of piston chamber 68. Contact between piston 70 and biasing element 18 therefore results in a lower travel limit for the position of piston 70 within cylinder 66, and therefore also establishes a maximum outward displacement of piston rod 72. Some overshoot of piston 70 can occur due to momentum of the parts, therefore circuit closure from contact between piston 70 and biasing element 18 provides an approximate lower travel limit for piston 70 and additional length of exposed biasing element 18 is provided to allow for some compression due to this motion.

The displacement of piston 70 and piston rod 72 can be used in conjunction with electrical connector assembly 10 to help control the feeding of material into an aluminum processing bath 110. Aluminum processing bath 110 can develop a crust 112 of hardened, generally non-electrically conductive material which forms by cooling. Crust 12 is located above a mixture 114 containing alumina film and electrically conductive molten aluminum which occurs between crust 112 and purely molten aluminum layer 116. During operation of the aluminum processing bath 110, it is desirable to add alumina material normally in the form of a non-conductive powder by using a chisel end 118 of piston rod 72 to break through crust 112 creating a crust aperture 120. By periodically displacing chisel end 118 through crust aperture 120 the crust aperture 120 is maintained to allow recharging of the alumina material through crust aperture 120 to create mixture 114.

During normal operation of aluminum processing bath 110, a first voltage is present in molten aluminum layer 116. When chisel end 118 of piston rod 72 breaks through crust 120 and contacts either or both of mixture 114 and molten aluminum layer 116, the voltage of aluminum processing bath 110 creates a current flow through piston rod 72 to system controller 86. When current flow is sensed by system controller 86 the flow of pressurized fluid into cylinder 66 is stopped to stop the travel of piston rod 72 toward aluminum processing bath 110, and pressurized fluid is directed into cylinder portion 68" to retract piston rod 72. Under normal operating conditions, physical contact between chisel end 118 of piston rod 72 and mixture 114 and/or molten aluminum layer 116 is sufficient to close the electrical circuit using system controller 86 to stop further flow of pressurized air via piston drive supply line 100 into cylinder 66. If chisel end 118 becomes corroded or layered with non-conductive material of crust 112, contact of chisel end 118 with mixture 114 or molten aluminum layer 116 will not close the electrical circuit and current flow will not be sensed by system controller 86. If this occurs, electrical connector assembly 10 provides an alternate or secondary path to complete the electrical circuit through system controller 86 to redirect flow of the pressurized air into cylinder 66 to force piston 70 to return by piston return path "H".

System controller 86 operates by sensing current flow due to the operating voltage of aluminum processing bath 110 which defines the first circuit voltage. When contact between chisel end 118 and alumina film 114 or molten aluminum layer 116 is insufficient to close the electrical circuit with system controller 86, contact between first piston surface 88 of piston 70 and biasing element 18 closes the secondary circuit via electrical conductor 84 and system controller 86. The secondary voltage, which can be the same or a different voltage than the first voltage of aluminum processing bath 110 is sensed by current flow to system controller 86. Sensing of the second voltage also indicates that chisel end 118 is in contact with mixture 114 and/or molten aluminum layer 116 based on a predetermined maximum displacement of piston 70 defined when piston 70 contacts biasing element 18.

A first connecting line 122 electrically connects cylinder 66 to system controller 86. A structural voltage path line 124 connected to a piston assembly structure 126 is used to provide the remaining electrical circuit path for the first or primary circuit between system controller 86, piston 70, and piston rod 72.

The secondary electrical circuit which includes electrical connector assembly 10 is created between system controller 86, structural voltage path line 124, piston assembly structure 126, piston 70, biasing element 18 and fastener 16 of electrical connector assembly 10, and electrical conductor 84. Referring again to FIG. 1, because biasing element 18 and fastener 16 are electrically isolated from cylinder 66 by tubular body 12, the secondary electrical circuit is only closed when piston 70 contacts biasing element 18. The primary electrical circuit includes system controller 86, structural voltage path line 124, piston assembly structure 126, piston 70, piston rod 72, mixture 114 and/or molten aluminum layer 116, and baseline voltage line 122. A computer 128 or similar processor can also be provided with operating system 90 which can be used to direct operation of system controller 86 such as to provide delay operating times, increased or decreased voltages, and/or to determine a period between operations of piston 70 and piston rod 72 to maintain the crust aperture 120 through crust 112.

Referring to FIG. 11 and again to FIG. 6, the components of electrical connector assembly 10 can include the following. A fastener/biasing element sub-assembly 130 is first created by rotating compressed connecting end 56 of biasing element 18 into threaded engagement with reduced diameter shank extension 52 (only partially visible in this view) of fastener 16. Compressed connector end 56 can be threadably rotated for example in a counter-clockwise or left hand direction until compressed connecting end 56 contacts a compressible element 53 such as an O-ring which can be positioned between compressed connecting end 56 and end face 55 of fastener 16. Compressible element 53 can be used to create a tension force between compressed connecting end 56 and end face 55 of fastener 16 to help retain biasing element 18. Compressible element 53 can be omitted when compressed connecting end 56 forms a connection with end face 55 of fastener 16 that resists rotational release. The male extension threads 54 of fastener 16 can also be provided as right-hand threads adapted to receive compressed connector end 56 using a clockwise rotation. A conductive member such as a conductive ring 131 is slidably disposed over shank 48 and male shank threads 50 to contact head 44 of fastener 16. The fastener/biasing element sub-assembly 130 is then inserted in the insertion direction "A" into open receiving end 14 of tubular body 12 until extending portion 58 is received within biasing element bore 22.

Fastener head 44 is thereafter rotated (using a tool such as an allen wrench) to threadably engage male shank threads 50 of fastener 16 with internal threaded bore 36 of tubular body 12. Fastener 16 is axially received on an assembly longitudinal axis 132 and is rotated until a conductive ring surface 134 of conductive ring 131 contacts a bore end surface 136 created in tubular body 12. At this time, a portion of extending portion 58 freely extends through and beyond boss 34 of tubular body 12. Boss 34 thereafter provides support to maintain biasing element 18 substantially coaxially aligned with assembly longitudinal axis 132. Electrical connector assembly 10 can therefore be disassembled by using an opposite rotation of fastener 16 for example to allow removal and replacement of biasing element 18.

A pressure containment seal is created by positioning a fastener seal member 138 such as an elastomeric O-ring in a circumferential slot 140 created in tubular body 12 proximate to bore end surface 136. Seal member 138 is compressed by contact with conductive ring surface 134, shank 48, and a surface defined by circumferential slot 140. To provide for connection of electrical conductor 84 and fastener 16, electrical conductor 84 is connected for example by soldering or swaging to conductive ring 131. Electrical conductor 84 then passes through access cavity 20. Anti-rotation pin 43 is connected to tubular body 12 at perimeter aperture 42 using a threaded connection, a frictional fit connection, or a similar mechanical connection to retain anti-rotation pin 43. Anti-rotation pin 43 extends away from end face 24 by a height which is less than a height of boss 34 determined with respect to end face 24.

Figure 12:
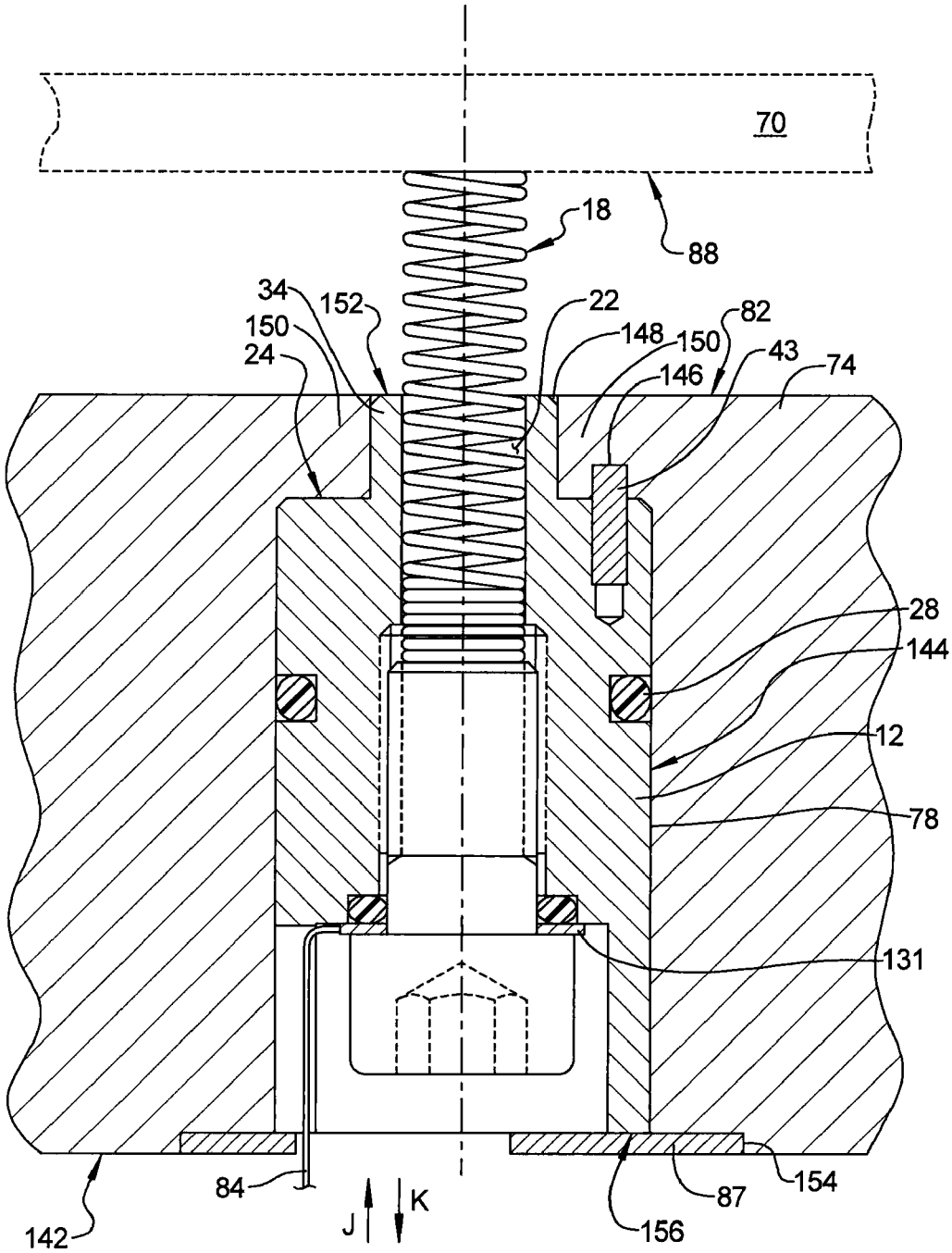
FIG. 12 is a cross sectional front elevational view of the electrical contact device shown connected to an end wall of a piston cylinder.

Referring to FIG. 12, the connection of electrical connector assembly 10 to cylinder end wall 74 is made as follows. Connector receiving bore 78 opens at an end wall exterior face 142 of cylinder end wall 74. Electrical connector assembly 10 is slidably inserted in an insertion direction "J" into connector receiving bore 78 such that seal member 28 is engaged against an inner wall 144 and until anti-rotation pin 43 is received in a blind pin receiving aperture 146. Insertion of anti-rotation pin 43 into pin receiving aperture 146 thereafter prevents axial rotation of electrical connector assembly 10 within connector receiving bore 78. At this time, boss 34 is received within a clearance bore 148 which is smaller in diameter than a diameter of connector receiving bore 78. Clearance bore 148 creates a shoulder portion 150 of end wall 74.

A free end 152 of boss 34 is positioned within clearance bore 148 and even with or below end wall interior face 82 so that no portion of boss 34 extends above end wall interior face 82 which could be impacted by piston 70. When end face 24 of tubular body 12 abuts against shoulder portion 150, the clamp ring 87 can be biased into engagement with the outer wall of a ring receiving counterbore 154 such that clamp ring 87 contacts a surface 156 at the open receiving end 14 of tubular body 12 to prevent displacement of electrical connector assembly 10 in a removal path "K" unless clamp ring 87 is removed.

Figure 13:
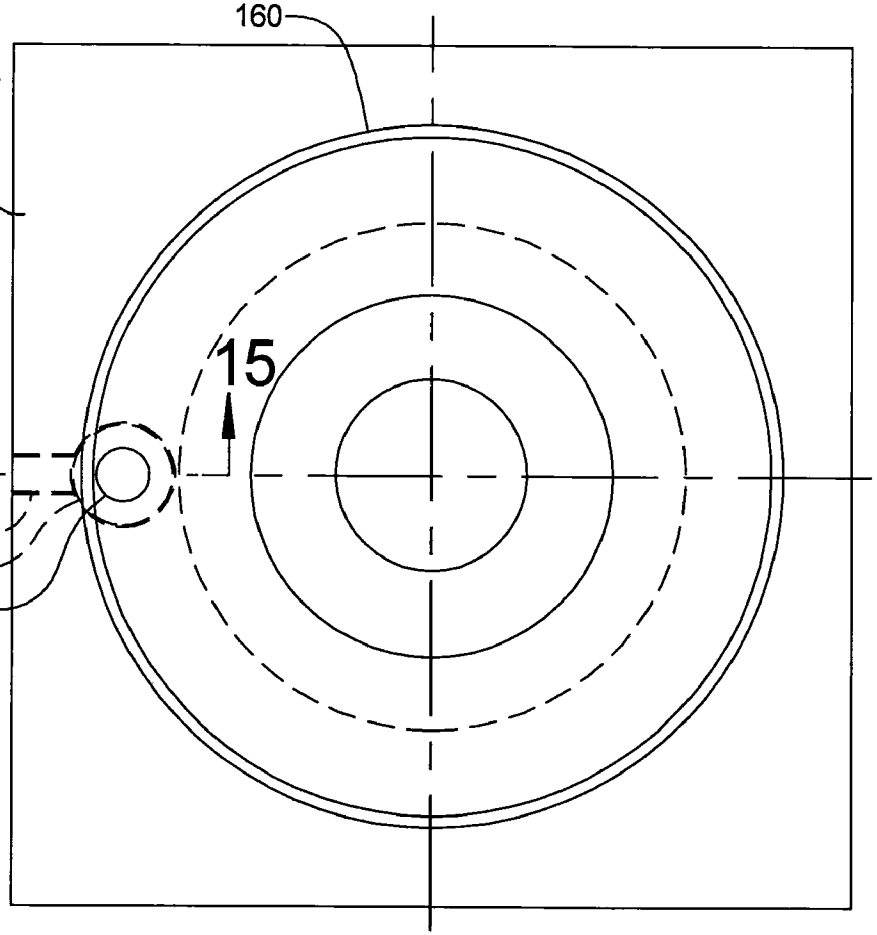
FIG. 13 is a top plan view of another embodiment of a cylinder end wall adapted to receive an electrical contact device of the present disclosure.
Figure 14:
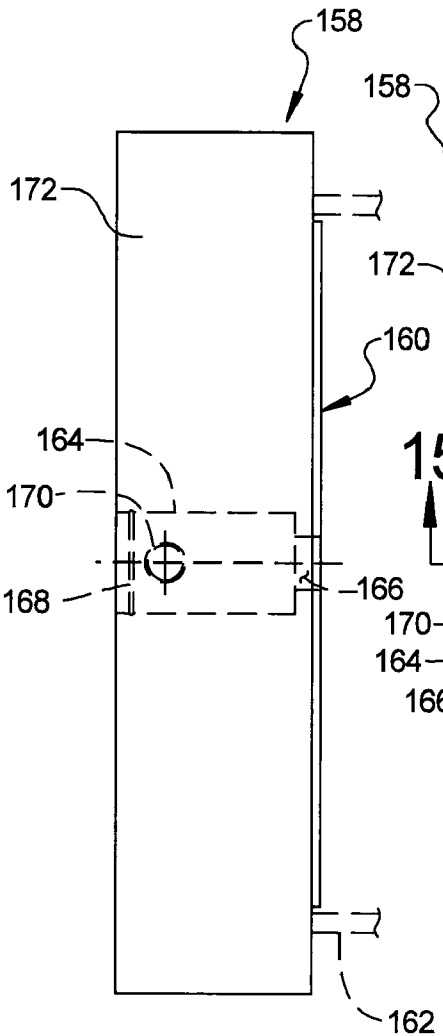
FIG. 14 is a front elevational view of the cylinder end wall of FIG. 13.
Figure 15:
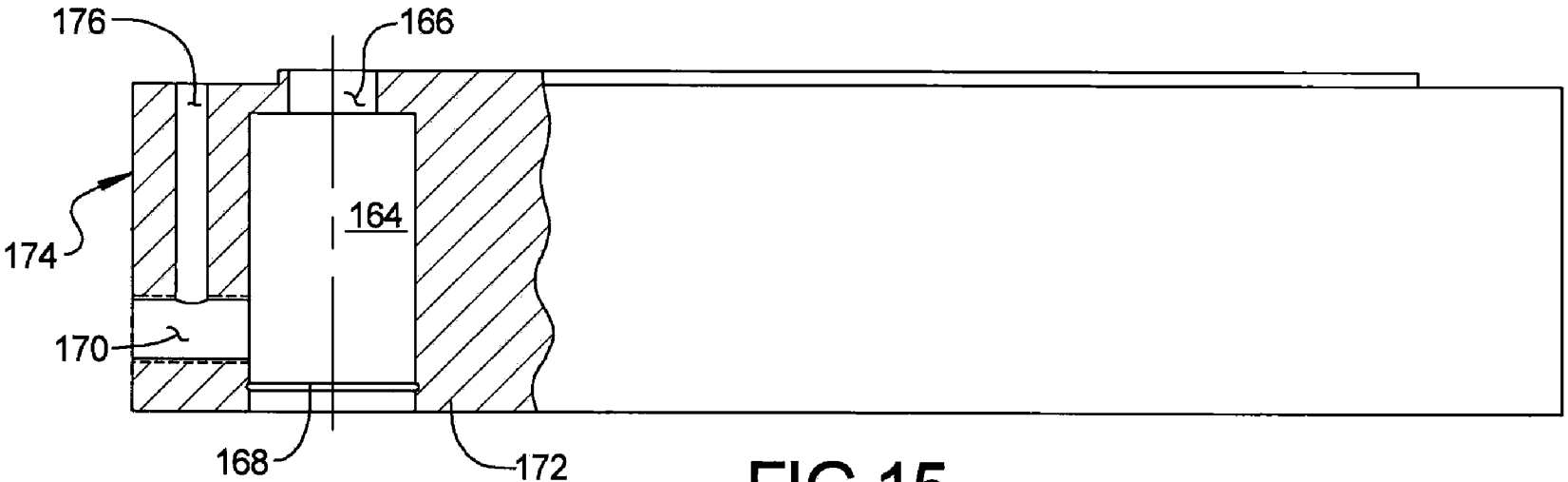
FIG. 15 is a partial cross sectional side elevational view taken at section 15 of FIG. 13.

Referring to FIGS. 13 through 15, and again to FIGS. 9 and 12, according to further embodiments a cylinder end wall 158 is modified from cylinder end wall 74 to include a raised ring 160 adapted to receive a cylinder 162 (partially shown in phantom). A connector receiving bore 164 is provided similar to connector receiving bore 78. A clearance bore 166 is provided to receive boss 34 of electrical connector assembly 10 (not shown in these views). A ring receiving counterbore 168 is provided to receive a clamp ring 87 (not shown in these views). A conductor passage bore 170 is oriented transverse to and opens into connector receiving bore 164. The access cavity 20 of tubular body 12 of electrical connector assembly 10 (not shown in these views) is aligned with conductor passage bore 170 to provide an alternate path for electrical conductor 84. Connector receiving bore 164 and conductor passage bore 170 are located in a plate 172 such that conductor passage bore 170 opens through a side wall 174.

It is noted items of the present disclosure can be modified without departing from the scope of the present disclosure. If the biasing element bore 22 is increased to approximately the size of the shank 48, the reduced diameter shank extension 52 can be deleted allowing a modified compressed connecting end 56 of biasing element 18 to be threadably engaged directly with shank threads 50 of fastener 16. Additional deflectable devices can also be substituted for the coiled spring design described herein for biasing element 18, such as a deflectable beam, or a bendable or looped shaft. Fastener 16 can also be connected to tubular body 12 without threads, using for example a press fit, an adhesive connection, a barbed or hooked connection, and the like.

An electrical connector assembly 10 of the present disclosure offers several advantages. By threading a fastener 16 into an electrically insulating tubular body 12 and extending a deflectable biasing element 18 from fastener 16, an electrical path can be created through fastener 16 by contact with biasing element 18. Further deflection of biasing element 18 can also be accommodated due to the free length of biasing element 18 that extends away from tubular body 12. A conductor can be connected between biasing element 18 and fastener 16 which can be led through an aperture of fastener 16 for remote connection. An anti-rotation pin 43 provided with tubular body 12 precludes axial rotation of electrical connector assembly 10. A seal member located in a circumferential or perimeter slot in tubular body 12 allows electrical connector assembly 10 to form a portion of a pressure boundary, such as a cylinder of a piston assembly. In this application, the biasing element 18 can complete an electrical circuit by contact with a piston 70, without deflection of biasing element 18, thereby obviating the need for a displaceable mechanical switch. The biasing element 18 can also include a plurality of coils defining a compressed connecting end that can be threadably connected to the fastener, providing a robust yet releasable connection.

What is claimed is:

1. An electrical contact device operable to complete an electrical circuit, comprising:

a tubular body of an electrically insulating material, the body including a seal member to permit the tubular body to be sealingly disposed within a cylinder;

a fastener received in the tubular body, the fastener including a shank and a plurality of threads;

a conductive biasing element having a compressed connecting end engaged with the plurality of threads, and an extending portion extending from the compressed connecting end; and the tubular body further including a biasing element clearance bore slidably receiving the extending portion of the conductive biasing element.

2. The electrical contact device of claim 1, wherein the fastener further includes:

a threaded portion of the shank adapted to be threadably engaged with the tubular body;

a portion of the shank defining a shank extension axially extending from the shank, the shank extension having the plurality of threads formed thereon; and a fastener head homogenously connected to the shank and oppositely positioned from the shank extension.

3. The electrical contact device of claim 2, wherein the tubular body further includes an open receiving end having a fastener clearance bore adapted to receive the fastener head when the external shank threads of the fastener are threadably engaged with the internally threaded bore.

4. The electrical contact device of claim 2, wherein the shank extension includes a plurality of male threads.

5. The electrical contact device of claim 4, wherein the compressed connecting end of the conductive biasing element includes a plurality of abutting coil members having a connecting end internal diameter which equals a root diameter of the threads of the shank extension.

6. The electrical contact device of claim 1, further including:

a conductive ring disposed in contact with a head of the fastener; and a conductor connected to the conductive ring and passed outward from the electrical contact device through a clearance aperture created in the tubular body.

7. The electrical contact device of claim 1, wherein the tubular body further includes an annular ring adapted to receive an elastomeric material O-ring as the seal member.

8. An electrical contact device operable to complete an electrical circuit, comprising:

a body of an electrically insulating material, the body including:

an open receiving end having a fastener clearance bore;

an internally threaded bore; and a biasing element clearance bore;

a fastener made of an electrically conductive material, the fastener including:

a shank having a plurality of external shank threads adapted to be threadably engaged with the internally threaded bore; and a shank extension extending axially from the shank; and a conductive biasing element having a compressed connecting end mechanically and conductively engaged with the shank extension, and an extending portion extending from the compressed connecting end and adapted to be slidably received in and partially extend out of the biasing element clearance bore.

9. The electrical contact device of claim 8, wherein the fastener further includes a fastener head adapted to be received within the fastener receiving bore of the tubular body when the external shank threads are threadably engaged with the internally threaded bore.

10. The electrical contact device of claim 8, wherein the shank extension includes a shank extension diameter smaller than a diameter of the shank.

11. The electrical contact device of claim 8, wherein the shank includes an end face proximate to the shank extension, the biasing element adapted to contact the end face when the compressed connecting end is fully engaged with the shank extension.

12. The electrical contact device of claim 8, wherein the body is tubular and includes at least one outward facing circumferential slot adapted to receive a compressible seal member.

13. The electrical contact device of claim 8, wherein the body includes a boss homogenously connected to an end face, the end face and the boss positioned opposite to the open receiving end, the boss having a bore adapted to slidably receive the extending portion of the biasing element when the external shank threads are threadably engaged with the internally threaded bore.

14. The electrical contact device of claim 8, wherein the body includes an access cavity oriented transverse to the open receiving end, the access cavity operable to provide access to a head of the fastener when the external shank threads are threadably engaged with the internally threaded bore.

15. The electrical contact device of claim 14, further comprising:

an electrical conductor received in the access cavity; and a conductive metal ring positioned against the head of the fastener, the electrical conductor connected to the metal ring.

16. An electrical circuit operating system, comprising:

an electrical contact device including:

a tubular body of an electrically insulating material, the body including an externally positioned seal member;

a fastener disposed in the tubular body; and a conductive biasing element having a compressed connecting end engaged with the fastener, and an extending portion axially extending from the compressed connecting end and outwardly with respect to the tubular body; and a displaceable member forming a portion of an electrical circuit, the electrical circuit closed when the conductive biasing element is contacted by the displaceable member.

17. The system of claim 16, wherein the displaceable member comprises a piston.

18. The system of claim 17, further comprising a cylinder defining a piston chamber, wherein the piston is slidably disposed in the piston chamber and operable in a drive path to contact the biasing element.

19. The system of claim 18, wherein the piston assembly further comprises an end wall of the cylinder having a bore adapted to slidingly receive the tubular body such that the seal member is operable to create a pressure boundary between the tubular body and the end wall.

20. The system of claim 19, further comprising a mechanical connector received in the bore adapted to retain the tubular body.

21. The system of claim 16, wherein the fastener includes a threaded extension portion.

22. The system of claim 21, wherein the conductive biasing element includes a compressed connecting end engaged with the threaded extension portion of the fastener, and an extending portion axially extending from the compressed connecting end.

23. The system of claim 22, wherein the conductive biasing element is a coiled compression spring having a plurality of abutting coil members defining the compressed connecting end and a plurality of spaced coil members defining the extending portion.

24. The system of claim 16, wherein the fastener includes a shank having a plurality of external shank threads adapted to be threadably engaged to the tubular body.

25. The system of claim 16, further comprising a control system operable to direct a pressurized fluid to displace the displaceable member.

26. An electrical circuit operating system, comprising:

an electrical contact device including:

a tubular body of an electrically insulating material, the body including a seal member;

a fastener disposed in the tubular body; and a conductive biasing element having a compressed connecting end engaged with the fastener, and an extending portion axially protracting from the compressed connecting end;

a displaceable member forming a portion of an electrical circuit, the electrical circuit closed when the conductive biasing element is contacted by the displaceable member; and an operating system operable to direct a pressurized fluid to displace the displaceable member.

27. The system of claim 26, wherein the displaceable member comprises a piston.

28. The system of claim 27, further comprising a cylinder defining a piston chamber, wherein the piston is slidably disposed in the piston chamber and displaceable in a drive path forced by the pressurized fluid to contact the biasing element.

29. The system of claim 28, wherein the piston assembly further comprises an end wall of the cylinder having a bore adapted to slidingly receive the tubular body such that the seal member is operable to create a pressure boundary between the tubular body and the end wall.

30. The system of claim 29, further comprising a pin extending from the tubular body received in an aperture created in the end wall to prevent rotation of the electrical contact device.

31. The system of claim 28, wherein the control system includes:

at least one valve operable to direct the pressurized fluid into the piston chamber to move the piston either toward or away from the biasing element; and a system controller operable to control operation of the at least one valve and to sense a voltage of the circuit, the voltage increasable from a baseline voltage by a supplemental voltage when the piston contacts the conductive biasing element.

32. An electrical circuit operating system for controlling operating of an aluminum processing bath, comprising:

an electrical contact device including:

a tubular body of an electrically insulating material, the body including an externally disposed seal member;

a fastener disposed in the tubular body; and a conductive biasing element having a compressed connecting end engaged with the fastener, and an extending portion axially protracting from the compressed connecting end;

a piston forming a portion of an electrical circuit, the electrical circuit closed when the conductive biasing element is contacted by the piston; and a piston rod connected to the piston and displaceable with the piston, the piston rod operable to break a crust of the aluminum processing bath.

33. The system for controlling operating of an aluminum processing bath of claim 32, further comprising a cylinder defining a piston chamber, wherein the piston is slidably disposed in the piston chamber and displaceable in a drive path to contact the biasing element operable to close the electrical circuit.

34. The system for controlling operating of an aluminum processing bath of claim 33, wherein the piston assembly further comprises an end wall of the cylinder having a bore adapted to slidingly receive the tubular body such that the seal member is operable to create a pressure boundary between the tubular body and the end wall.

35. The system for controlling operating of an aluminum processing bath of claim 33, further comprising at least one valve operable to direct a pressurized fluid into the piston chamber to move the piston either toward or away from the biasing element.

36. The system for controlling operating of an aluminum processing bath of claim 35, further comprising a system controller operable to control operation of the at least one valve and to sense a voltage of the circuit, the voltage increasable from a baseline voltage by a supplemental voltage when the piston contacts the conductive biasing element.

* * * * *